US011433291B1

(12) United States Patent
McClain

(10) Patent No.: US 11,433,291 B1
(45) Date of Patent: Sep. 6, 2022

(54) LIGHT-BASED BASEBALL TRAINING SYSTEM

(71) Applicant: Ryan McClain, Lowell, AR (US)

(72) Inventor: Ryan McClain, Lowell, AR (US)

( * ) Notice: Subject to any disclaimer, the term of this patent is extended or adjusted under 35 U.S.C. 154(b) by 0 days.

(21) Appl. No.: 17/497,089

(22) Filed: Oct. 8, 2021

Related U.S. Application Data

(60) Provisional application No. 63/089,612, filed on Oct. 9, 2020.

(51) Int. Cl.

| | |
|---|---|
| ***A63B 71/00*** | (2006.01) |
| ***A63B 71/06*** | (2006.01) |
| ***F21V 23/06*** | (2006.01) |
| ***F21V 23/00*** | (2015.01) |
| ***A63B 69/00*** | (2006.01) |
| *F21Y 115/10* | (2016.01) |
| *A63B 102/18* | (2015.01) |
| *F21Y 103/10* | (2016.01) |

(52) U.S. Cl.
CPC ..... *A63B 71/0622* (2013.01); *A63B 69/0002* (2013.01); *F21V 23/003* (2013.01); *F21V 23/06* (2013.01); *A63B 2071/0694* (2013.01); *A63B 2102/18* (2015.10); *A63B 2225/74* (2020.08); *F21Y 2103/10* (2016.08); *F21Y 2115/10* (2016.08)

(58) Field of Classification Search
CPC ..... F21S 2/005; F21V 23/003; F21V 23/06; A63B 71/0622; A63B 69/0002
See application file for complete search history.

(56) References Cited

U.S. PATENT DOCUMENTS

| | | | | |
|---|---|---|---|---|
| 9,095,762 | B2 | 8/2015 | Buresta | |
| 2012/0063138 | A1* | 3/2012 | Leadford | F21V 15/015 362/249.02 |
| 2014/0362574 | A1* | 12/2014 | Barrett | F21S 2/00 362/249.06 |
| 2018/0332689 | A1* | 11/2018 | Clout | H05B 47/18 |
| 2020/0179755 | A1* | 6/2020 | Ristas | G09B 19/0038 |
| 2020/0294466 | A1* | 9/2020 | Risinger | G09G 5/026 |

* cited by examiner

*Primary Examiner* — Gerald J Sufleta, II
(74) *Attorney, Agent, or Firm* — Wright Lindsey Jennings, LLP; Meredith Lowry

(57) ABSTRACT

The present invention provides a system and method for sport training by providing an illuminated representation of a base runner or other runner that is programmable or controllable by electronic means to simulate the movement of a specific runner or ideal runner to provide instruction to a team.

16 Claims, 3 Drawing Sheets

LIGHT-BASED BASEBALL TRAINING SYSTEM

CROSS-REFERENCE TO RELATED APPLICATIONS

This application claims priority to and is a continuation-in-part of U.S. application Serial No. U.S. application 63/089,612, filed Oct. 9, 2020, the disclosure of which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

The present invention relates to a system and method of sports training. In particular, the invention relates to a system and method providing an illuminated representation of a baseball baserunner or other sports runner for the purposes of training players to react accordingly.

The use of illuminated systems for sports training is known in the art.

However, these illuminated sports training systems and methods and others like them suffer from a number of deficiencies. Thus, there is a need in the art to provide a system and method of illuminated sports training that is scalable, programmable and controllable. The present invention satisfies these and other needs.

SUMMARY OF THE INVENTION

In order to overcome the above-stated problems and limitations, and others, and to achieve the noted objects, there is provided a light-based baseball training system. The present invention is broadly characterized as a virtual sports training system. More specifically, it is intended to optimally assist baseball players practice defense to develop mental and physical proficiency during live baseball play by using simulated baserunners to mimic live baseball situations.

The system intends to fill a perceived gap, especially in youth baseball, where instructional time by coaches seems excessively dedicated to practicing individual, physical skills to players such as throwing, pitching, catching, fielding, hitting, bunting, base running, sliding, etc at the expense of practicing equally important, whole-team exercises that are intended to develop team chemistry and broader situational knowledge aspects of the game. It is these gaps the present seeks to fill.

The physical aspects of the game such as mechanics and technique appear generally more conducive to being taught to and practiced by relatively small groups of players. For example, a single person can practice hitting a ball off a Tee. Two people can practice the basic skills of throwing and catching together. One person can practice sliding. A single person can practice pitches across even an unoccupied batter's box. Drills such as these which feature the partitioning of teams into small groups or even individuals at a time, are termed discrete coaching methods. Discrete methods are efficient and afford a relatively larger number of repetitions for each player during practices and for this reason, represent a convenient practice default for teams wishing to practice physical skills with high repetitions ("reps"). Since "practice makes perfect", the high volume of repetitions available through discrete coaching methods means most teams will benefit from a certain amount of this kind of work. Unfortunately, while discrete methodologies are beneficial for developing individual, physical abilities, they have several weak points. For instance, discrete methods rely on breaking teams into groups so they are of little help in honing team chemistry between players. Such partitioning is also ill-suited for teaching certain aspects of the game that only broad, large-scale modeling can address. Mental aspects of baseball defense such as situational awareness, situational recognition and decision-making during live play are difficult to model and coach using discrete methods. Large scale modeling featuring a complete baseball diamond along with a compliment of baserunners are better equipped to more richly and authentically model defensive situations for teams in a way that helps them develop important mental proficiency to go along with physical skills. Additionally, discrete method drills often fail to present authentic pressure to players. For instance, it is common for teams to practice fielding live, batted balls while coaches instruct players to make subsequent throws to bases without simultaneously modeling base runner pressure. Practicing fielding skills, mechanics and techniques without simultaneous baserunner pressure, though, is sub-optimal. Players miss out on appreciating and practicing the time and space aspects of playmaking in such scenarios. They can become so focused on technique that they forget defensive plays must also be made 'on time'. A good example of this is illustrated in considering that defensive plays should periodically not result in a thrown ball. When baserunners are too substantially-advanced towards a base, there is a threshold of time past which there is no realistic opportunity for a defensive player to garner an out and consequently, no throw should be attempted. However, the decision-making of such plays requires fine discernment of both time and space. Fielders must factor their time and space (distance) throwing abilities while simultaneously judging the time and space demands being presented by baserunners approaching a forward base. Fielders must perform such comparisons, essentially, instantaneously and such scenarios therefore represent a considerable challenge especially for youth players. Discrete methods typically fail to model baserunner pressure and, therefore, are likewise limited in their ability to develop mental proficiency in such scenarios for players. The present system therefore provides an important, appropriately-scaled and rich modeling system that allows players to practice both physical and mental aspects of defensive baseball in a way that more accurately reflects authentic game play.

Above, it is established that for players to achieve a "practice like you play" standard, this is best accomplished when coaches can model "play-like practices"—that is, the practices themselves are structured like actual competitive baseball contests between two teams. For this to occur, however, it is clearly necessary that a means for portraying or modeling an opposing team's offense is needed. It is a simple enough matter for coaches to hit batted balls to fielders to simulate hits by an opposing team but simulating baserunners is typically a considerably more difficult matter. Naturally, using human players as baserunners is the most authentic modeling method. However, teams wishing to practice situational defense using live runners face several immediate problems.

First, a problem with player quantity can arise. Most conspicuously, modeling all the situations that are possible in game play requires a minimum of four baserunners. Unfortunately, teams often simply don't have a sufficient number of extra players to serve as baserunners. Teams generally prefer to self-restrict their player count to only one or two extra players (beyond the standard nine it takes to field a full team). Having fewer players maximizes batting line-up turnover which is a hitting (offensive) advantage in games and also maximizes defensive playing time for each player.

One strategy teams commonly use to manage a lack of baserunners is to instigate a rotation scheme where certain players hit and run while defensive players gain experience making plays. This typically goes on for some time before the few baserunners are swapped out for a different group in the field. Rotation schemes creates inefficiencies, though, as considerable practice time is wasted rotating players. Defensive players must go to the dug-out, find their bats, batting gloves, batting helmets, take practice swings and move to home plate to resume live practice. Meanwhile, kids rotating from offense to the outfield similarly must re-equip their fielding gear and get to their positions before play can resume. It is a conceptually simple matter for a coach to call for a player rotation but, realistically, youth players tend to be slow moving, fail to keep track of their gear and are uncoordinated in equipping it, all tending to waste instructional time. In short, player quantities on many teams discourage them from practicing whole-team drills and, even when they do, it tends to be a highly inefficient affair.

Rotation scheme issues aren't the only problem associated with modeling baserunners with human runners, though. Teams trying to simulate baserunners with human runners waste substantial time waiting for baserunners to "reset" to their starting bases between repetitions. This tends to be especially true if coaches try to re-run particular play scenarios where, say, a player decision-making error occurred and the exact same baseball situation needs to be re-simulated. Additionally, the problem of "wasted reset time" tends to get noticeably worse with subsequent repetitions as such methods rely on baserunners performing iterative sprints and quick resets for sustained periods representing a tall order for, especially youth players.

Another issue with using actual players for modeling baserunners is that youth are typically poor modelers. They're often just as inexperienced at the task of baserunning as defensive players are at defending. This can lead to practice stoppages for coaches to explain proper baserunning technique and strategy to the very kids who are being relied upon to provide sound offensive modeling to those practicing defense. Furthermore, when practicing defense, coaches are often attempting to model particular baserunning scenarios for which they would like their team to develop proficiency in handling. For such specific modeling, they would be greatly aided by having immediate and precise control of offensive baserunners to accurately and consistently portray certain "looks" to their team. Youth players, though, even when they're inattentive, typically demonstrate a considerable lag in hearing, understanding and executing real-time modeling instructions. For these reasons, trying to use actual players to model offense for defensive practice is typically neither efficient nor effective.

Another historical impediment to youth baseball coaching and learning is one that is experiential in nature. An experience issue arises as a limitation owing to the fundamental nature of the sport of baseball. Baseball is a play-based game that involves only one batted ball during each play. During practices, this means the decision-making experience gleanable from any single play or practice repetition, even when fielding an entire defensive team, is largely only available to one or two players—usually the player to whom the ball was hit and the one or two sequential players possibly receiving/making subsequent throws. In short, only about two out of nine players get critical decision-making experience per practice repetition which tends to place a premium on each one. It may be tempting to discount scarcity in experience by rightfully identifying that every single player should be reacting to every batted ball and therefore every player is gaining experience during each play. Certainly, it is defendable that all player movements are indeed valuable experience—even without the ball in hand. The crux of successful defensive play outcomes, though, will still always rest largely in the good and timely decisions of those handling the ball on any given play. Unfortunately, however, and importantly for the solution of the proposed invention, this experience is largely only available to relatively few players during each repetition and so the number, diversity and quality of those repetitions becomes extremely important for an entire team to progress.

When one then considers each repetition (along with its associated verbal coaching) can take up to several minutes and that practices are generally limited from one to two hours, an economy of sorts is created which establishes the value of each repetition. Marginally speaking, repetitions become an increasingly valuable commodity the fewer of them that exist. As described above, for discrete-method exercises such as line drills, station drills, batting cage work and the like, repetitions are plentiful and therefore, figuratively-speaking, cheap. Unfortunately, there has been a considerable and long-standing bottleneck for teams wishing to practice using richly-modeled, large-scale methods featuring baserunners on large diamonds. This predicament is one that all youth baseball teams have had to deal with as long as baseball has been around but unfortunately is also the principal driving force that has created the inequality of relatively-cheap, discrete-method, physical repetitions and comparatively rare and therefore "high-value" mental repetitions. The proposed system solves this dilemma by providing a system that can model myriad baseball defensive situations just as fast as discrete drill can be performed, effectively leveling the field when it comes to mental proficiency development. Essentially, the training system of the present invention is a novel virtual training system that frees baseball coaches from a long-standing limitation where high volume reps are only available to skills training. It releases them to offer youth considerably more situational baseball training in an extremely efficient manner and with unprecedented control over modeled baserunner scenarios.

The system of the present invention cannot increase the pace of live play which is inherent to the game of baseball in the form and by the rules it is played today. Instead, the present invention allows teams to practice using a richly-modeled method that provides baserunner pressure and that involves a sufficiently large enough scale to enable player coordination and chemistry development in defensive play with each other. Furthermore, it accomplishes this robust modeling with tremendous efficiency. It allows coaches to enable baserunners, on command, and essentially instantaneously, thereby eliminating the need for the above-described rotation schemes. Repetition "reset time" is also avoided as the training system allows coaches to instantaneously reset baserunners to prior base locations to replay a situation without having to wait on real baserunners to jog back to their starting positions. The training system allows reliable, repeatable, and customizable control of baserunners to precisely challenge players on particular baseball situations.

The present system also allows coaches to customize parameters to precisely cater to and support player learning and knowledge absorption. A good example of this is the functionality the present invention offers in adjusting baserunner velocities in real-time. The invention allows coaches to make nuanced adjustments to the speed of baserunners in the middle of live play and while they are "mid-path". This gives coaches extremely fine control in slowing live play down, just enough, to help youth recognize and respond to challenging situational patterns while still giving them ample time to make successful, positively-reinforcing plays that develop proficiency. Even relatively experienced players being introduced to a new situation can benefit from a coach temporarily adjusting the degree of difficulty down by slowing baserunners during initial practice repetitions. As player proficiency increases, the reverse is also true and baserunner speeds can be steadily increased to present more challenging time and space conditions.

The present system also provides benefits to teams using traditional discrete practice methods which focus on physical skills development. It does this by presenting simulated baserunners for such drills. This creates a practice context that is more game-like both in visual terms as well as emotional and psychological terms on account of the pressure such baserunners present to players attempting to make plays. It is widely accepted that athletic performance without competitive pressure is considerably easier and the system therefore provides value to teams wishing to more authentically model game-like pressure in order to better prepare players for actual games. The system does this while simultaneously offering nuanced control through baserunner speed adjustment to customize exactly how much pressure is presented. Meanwhile, the system is easily capable of presenting baserunner modeling in the frequency and at the pace of repetitions associated with discrete drills.

The present invention provides a system and method for providing a runner simulation to allow coaches or instructors to teach game mechanics and strategy to players of a game. Specifically, the proposed invention is directed to the sport of baseball, but other running sports may utilize the scalable sport training system of the present invention.

It is an object of the present invention to provide a system to simulate an athletic runner.

It is an object of the present invention to provide a method to simulate an athletic runner to provide instruction to athletes.

It is an object of the present invention to provide a system to simulate and control an athletic runner.

It is further an object of the present invention to provide a system to simulate an opposing baseball team's baserunners for the purpose of allowing a practicing baseball team to exercise playmaking.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION OF THE INVENTION

Figure 1:
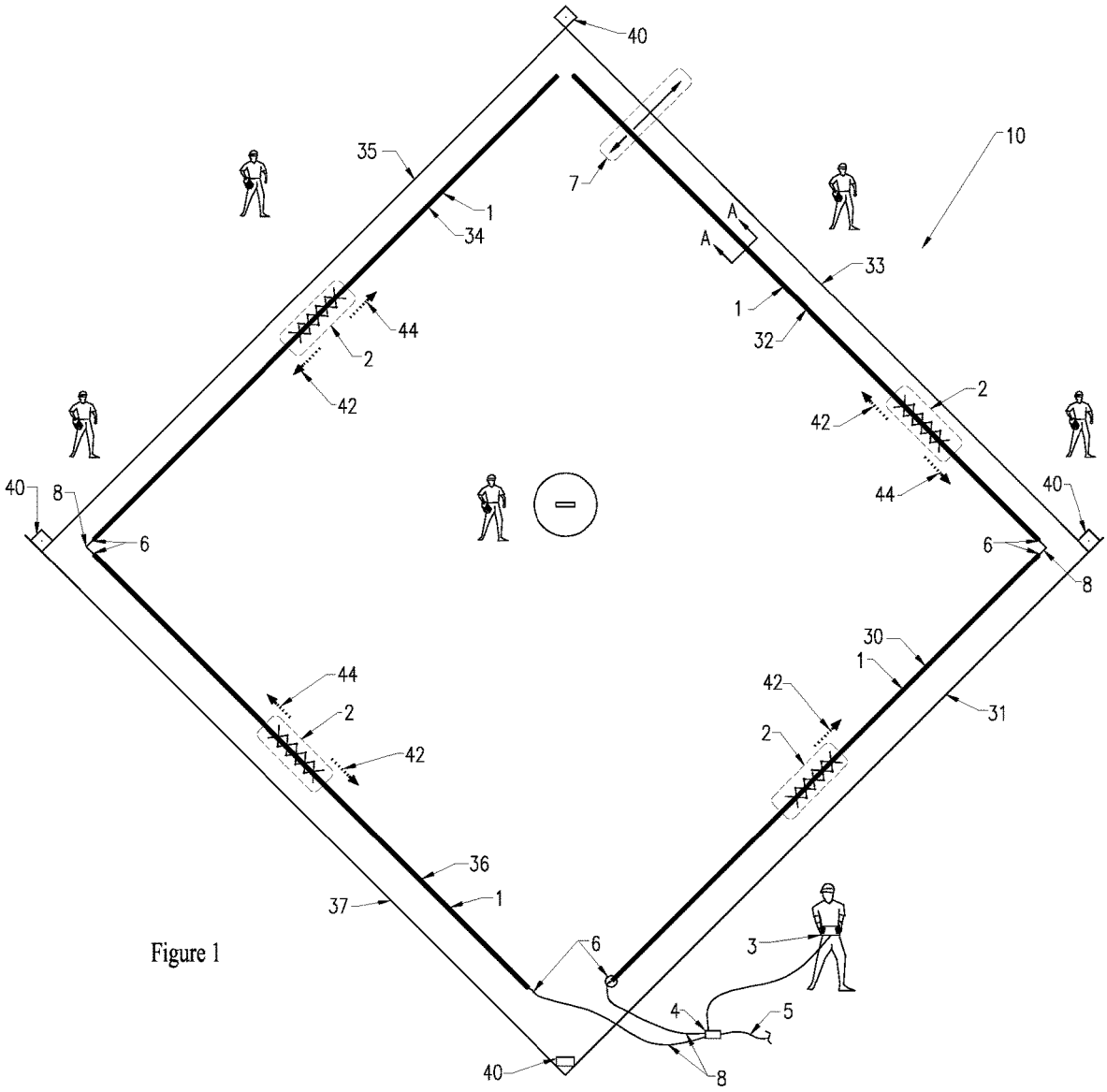
FIG. 1 is a top view of the light-based baseball training system.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

It will be understood that, although the terms first, second, etc. may be used herein to describe various elements, these elements should not be limited by these terms. These terms are only used to distinguish one element, from another element. For instance, a first element discussed below could be termed a second element without departing from the teachings of the present invention. Similarly, the second element could also be termed the first element.

The term "and/or" includes any and all combinations of one or more of the associated listed items. The terminology used herein is for the purpose of describing particular embodiments only and is not intended to be limiting. As used herein, the singular forms "a," "an" and "the" are intended to include the plural forms as well, unless the context clearly indicates otherwise.

It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

As used herein, a light emitting diode (LED) is an electronic device that emits light when electricity is applied to it. LED's come in different colors and a red, green and blue LED are commonly packaged into a single discreet component that, itself, has an onboard microcircuit for driving each LED. Such packaged, individually-addressable multi-colored light packages are commonly referred to as LED red green and blue (RGB) "pixels." These packaged electronic pixels are still very small, approximately no larger than ¼" by ¼" square.

As used herein, a human machine interface (HMI) is a device which allows a human user to interact with a controlled system by offering various means of input. HMI's can be wired or operate via wireless technology. They can feature physical buttons or, on certain technology, rely on virtual buttons activated through screen presses and/or device gestures when an HMI is equipped with accelerometers.

As used herein, a pixel is a single surface mounted device (SMD) LED.

As used herein the abbreviation RGB refers to red green and blue.

As used herein, the abbreviation SMD refers to a surface mounted device.

As used herein, the abbreviation TFT refers to a thin film transistor. Specifically, the TFT has a screen type interface with capacitive touch capability or equivalent technology that allows input by way of screen touching.

As used herein, the abbreviation uC stands for microcontroller.

As used herein the abbreviation VT stands for virtual trainer.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Referring now to the drawings, in which like numerals represent like components throughout the several views, the preferred embodiments of the present invention are next described. The following description of one or more preferred embodiment(s) is merely exemplary in nature and is in no way intended to limit the invention, its application, or uses.

Looking at the drawings in detail, and initially to FIG. 1, numeral 10 generally designates one embodiment of the present system representing a standard baseball field of indefinite size composed of lighting strips 1, specifically four separate LED strips (one for each basepath between bases 40). As shown in FIG. 1, a first light strip 30 is positioned along a first baseline 31. A second light strip 32 is positioned perpendicularly to the first light strip 30 along a second baseline 33. A third light strip 34 is positioned perpendicularly the second light strip 32 and parallel to the first light strip 30 along a third baseline 35. A fourth light strip 36 is positioned perpendicularly to the third light strip 34 and parallel to the second light strip 32 along a fourth baseline 37. The exact positioning 7 of light strips 1 along basepaths may vary in order to optimize light strip 1 length. Safety considerations may also affect positioning 7.

The present invention 10 may be offered in various field sizes, however. In fact, the flexible nature of LED technology in combination with infinite software flexibility allow the present invention to have multiple configurations for the consumer in terms of field size. Recall a baseball diamond is abstractly but simply comprised of only four line-segments. Therefore, the present system could be implemented with a configurable user setting that would allow an entire baseball diamond to be portrayed by shaping any number of LED strips 1 (even a single LED strip) into the 'diamond' shape the system 10 is deployed on.

LED strips 1 are commonly manufactured and sold by assembling multiple LED pixels mounted along strip lengths in linear fashion. Digital communication protocols and power requirements associated with controlling LED pixels along an LED strip 1, typically vary by LED strip make and model. In one common method, each pixel is powered and passed a control signal, conforming to any number of optional industry-standard protocols, by the pixel before it via wiring embedded within the strip that passes between pixels. The control signal is a digital (binary encoded) signal that is passed down the length of a strip 1. Each LED within each pixel receives its own illumination instructions from the signal and instructs subsequent pixels if and how it should be illuminated.

Figure 2:
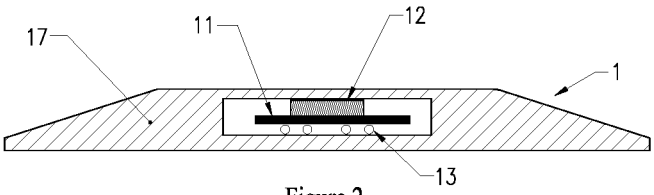
FIG. 2. is a cross-sectional view of the same.

Individual pixels illustrated at FIG. 2, 12 on LED strips can be commanded at very rapid speeds, limited only by system 10 electronic processing speed and circuitry. Update speeds for LED strips 1 are typically fast enough such that entire strips worth of individual pixel illumination commands can be digitally sent and displayed at speeds surpassing the threshold necessary for producing animated effects, and this, in fact is a common creative use for LED strips among especially physical computing/maker communities. The animation of individual or groups of pixels combined with the extremely wide color gamut available in digital LED strips allows for tremendous visual creativity and flexibility and which are key aspects the present system leverages.

Software or hardware settings could be used to switch between pre-defined or user-adjustable software configurations that identify the number of LED pixels assigned to represent a basepath. In a large-scale configuration, one or more entire strips worth of LED pixels would represent a single basepath, say the basepath between first and second base.

However, through the configuration setting, separate programming could be invoked which virtually divided the pixels of even a single LED strip, into four equal segments—each representing the four separate segments (ball-players) comprising a baseball diamond. With a single LED strip then spatially laid out in the shape of a diamond, the system could function the same as a multi-strand configuration but at a smaller overall physical scale and presumably price.

Other variables such as the base runner pulse length and base runner speed could be reduced to match the scale of each configuration.

Using function-based or object-oriented programming techniques, many if not all fundamental base runner pulse manipulation and light rendering functions/methods could be programmed in such a way that their software implementation would be re-usable regardless of the LED basepath length. For instance, the function or method used to increment the baserunner pulse location between visual frames (to simulate a baserunner moving down a basepath) would be the same for, essentially, any basepath length, at least any basepath length longer than the baserunner pulse itself.

The current invention system is envisioned to be offered as an indoor system; however, an outdoor, weatherproof model could be offered where LED strips were outdoor/weather-proof rated and electronic cabinetry had similar weatherproof ratings.

As shown, in FIG. 1, the system 10 is composed of at least one LED light strip 1 with addressable color light-emitting diodes, namely RGB pixels, along the length of the light strip 1. A light strip 1, as discussed above, can be arranged in multiple configurations and as shown, is arranged in a traditional basepath configuration running from home plate to first base to second base to third base and back to home plate using typically, one or more light strips running from one base to another along the basepath. An illuminated segment 2 of the light strip 1 represents a base runner and is configured to be manipulated by a user of a human machine interface (HMI) 3 (shown in more detail in FIG. 4). The light strips 1 and HMI 3 are connected to a micro-controller (uC) 4 for processing HMI 3 input and issuing control signals necessary to manipulate the light pulse 2 along the light strip 1 forward 42 longitudinally along the length of the light strip 1 or backward 44 longitudinally along the length of the light strip 1. The micro-controller 4 and the light strips 1 are powered by a power supply 5, such as a 120V building outlet, or a battery-powered power source for mobile applications of the invention 10.

Figure 3:
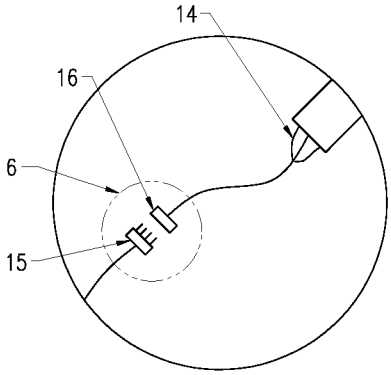
FIG. 3. is an enlarged view of the quick-connect fitting for the same.

As shown in FIG. 1, the corners or base positions between the light strips 1 have a quick release connection 6, which is discussed in more detail in FIG. 3.

As shown in FIG. 2, a cross-section of an LED strip assembly 1 is shown. The flexible substrate 11 of the LED strip 1 is located centrally and housed in molding 17 for protection and maintaining strip 1 orientation. The molding 17 may be translucent or transparent the strip 1 to allow the lighting strip 1 and pixels that form pulse 2 to be viewed. Alternatively, a flush mount of the system 10 is envisioned. This version would be most applicable to permanent installations featuring raised or artificial flooring in which the system lighting strips 1 could be permanently installed such that the strips 1 were flush with the field of play. Encasing molding 17 largely intended to maintain strip orientation would likely not be required in such an installation as a recessed mounting channel could serve the same purpose. The flush-mount system is expected to be most beneficial for school, club, professional and similar teams that have their own indoor facilities that such permanent installation would be most beneficial. The more permanent nature afforded by a flush mount system would eliminate set-up/take-down time, while its low profile would also provide more protection for players (a flush-mount system would present little or no profile for ball deflections and similarly reduce the potential for trip hazards).

As mentioned above, the quick release connection 6 allow for connection of the strips to each other 1, to intermediate electrical cables 8 (used for electrically connecting subsequent system components) and to the micro-controller 4. The wiring 14—the power, ground and signal wires—of the first strip 1 are joined to a single terminating connector 15 that mates with a corresponding joining connector 16 on another strip 1.

Figure 4:
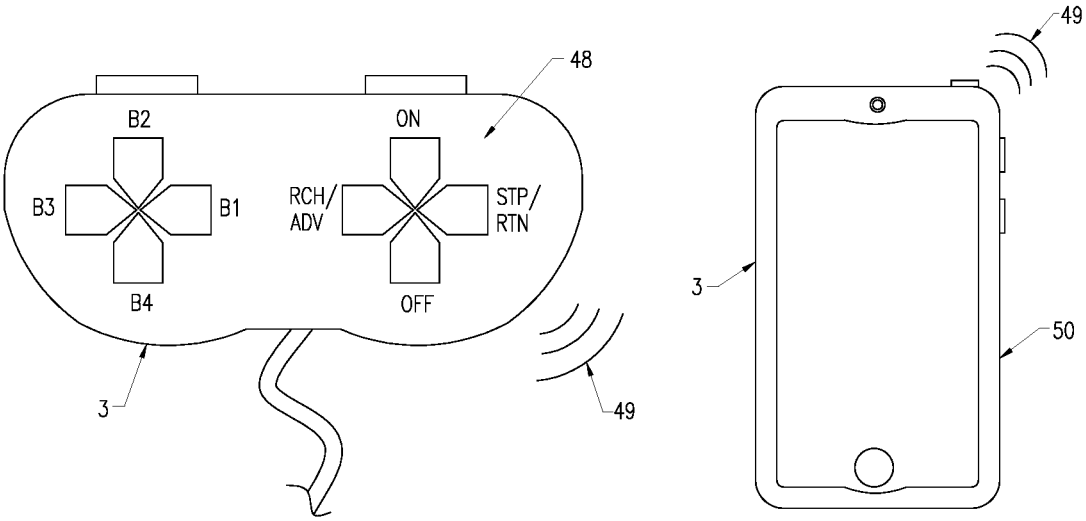
FIG. 4 is an enlarged view of the controllers for the light-based baseball training system.

As shown in FIG. 4, two types of HMI instrument 3, a conventional game controller 48 and a personal electronic (Smart) device 50, are shown which are separate options that allow user to input commands for illuminated pulses 2 to appear and be animated along the light strips 1. The conventional HMI 3 may be a wired device or wireless game controller that communicates through Bluetooth® or other wireless technology 49. The personal electronic (Smart) device option wirelessly connects through Bluetooth or other wireless technology 49. If the system 10 is implemented using a conventional controller 3, this is envisioned to include either a custom manufactured version or an one existing in the market that is available for implementation through a licensing agreement such as those sold with Sony® Playstations® or Xbox® units.

Wireless-based systems must have a wireless chip in the circuitry of the base microcontroller but provide flexibility in the system. For instance, a wireless system allows a coach to move around the field of play during live scenarios. In this embodiment, smart devices such as tablets and phones (Eg. iPhone® or Android®) would use a downloadable application ("App") that allowed users to connect to and control all or a portion of the present invention 10. This option promises to offer a great deal of flexibility, interaction and expansion functionality to system users. For instance, family members of youth players, could use smart-devices to connect to the system 10 to assist in pulse 2 control. The head coach would assign connected "virtual assistants" to manage either certain base paths, or possibly assign them to manage individual baserunners. The benefits of such an input scheme are intriguing as this would allow the system 10 control overhead burden to be distributed to bystanders while affording coaches the freedom to give more attention to coaching. For other family members otherwise resigned to simply watch and cheer, such functionality would give them the chance to truly be engaged in helping their team improve.

Figure 5:
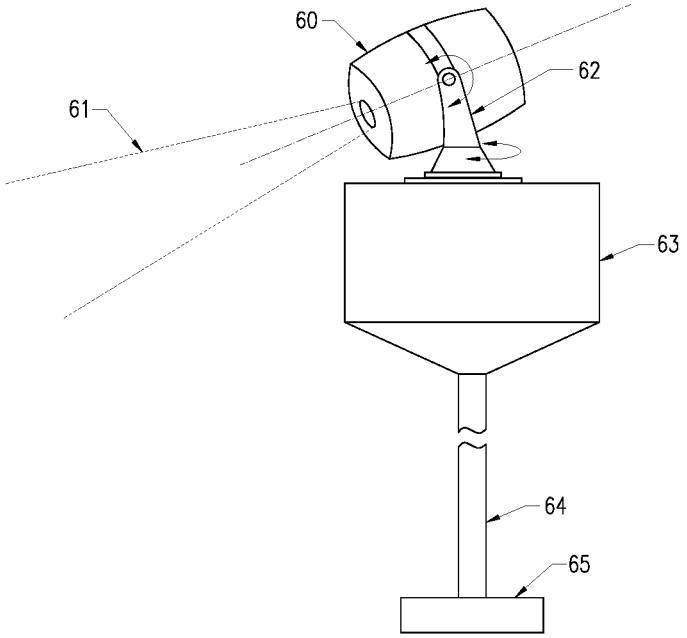
FIG. 5 is a side view of a light projector for the light-based baseball training system.

An alternative system and method for lighting a baserunner is shown in FIG. 5. A light projector 60 for projecting a focused spot light onto the ground to represent a baserunner is shown. The projected beam 61, as with the pulse 2, is illuminated on the basepaths and controlled to appear as animated baserunners. A projector harness 62 is a powered multi-degree-of-freedom servo connected to a housing 63 which allows the beam 61 to be moved and swiveled along the basepath to animate pulse 2. The housing 63 encases the system electronics, such as the microcontroller and provides connections from the microcontroller to the light projector 60. This alternative system may include a pedestal base 64 to elevate the projector 60 and a connector pedestal 65 to secure the pedestal-mounted portions of the alternative system 10 to the ground or surface.

The system 10 allows users to separately identify targets and invoke commands using the HMI 3 that act on those targets. Targeting might include identifying an empty base 40 or associated basepath position where the action of enabling a new baserunner is to occur. Conversely, a user might wish to target an existing baserunner currently being animated (running) along a basepath for the purpose of issuing it a "stop" command. Targeting is simply the process of pressing a physical or virtual button on the HMI 3 that identifies a basepath or baserunner for the purposes of subsequently issuing a particular command. Whenever no targets are identified and a command it issued, the command is applied to all positions. Targeting options simply follow traditional baseball conventions and viable targets are first base, second base, third base and home. Targeting schemes may alternatively reference basepaths instead of bases to accomplish targeting in which case viable targets are the basepaths between home/first, first/second, second/third and third/home.

A user can command baserunners in the following ways: On/Off or causing the associated baserunner pulse to illuminate/de-illuminate) by targeting a basepath and pressing the appropriate physical or virtual on/off buttons on the HMI 3; Advance or progressing the baserunner downstream along the basepath until otherwise commanded; Reach or commanding the baserunner to progress towards the next downstream base; Stop or commanding a baserunner to stop that will immediately stop the targeted baserunner pulse 2 being animated in either direction (downstream or upstream); Retreat or commanding the baserunner pulse to progress upstream towards a prior base; Lead-Out or slowly progress downstream towards the next base; Lead Back or slowly progress upstream towards a prior base.

Features are a primary programming aspect of the present invention. The features envisioned support the certain drills described below and their implementation with the present invention is described more fully below. Wherever the term baserunner is used in the description of drills below, the system 10 implements these as one or more pulses 2 or a combination of illuminated LED pixels suitable for portraying a visible manifestation to support implementation of the described drills. Programmed and hardware-based features of the system 10 allow a user to implement and initiate pre-set or user-adjustable static and dynamic (animated) patterns of light along the basepaths such as the pulse 2 in a way that support and facilitate the implementation of said drills.

In general play, the most basic envisioned usage of the system, the system 10 involves simply placing and commanding baserunners while real offensive players or coaches hit balls to defensive players. Defensive players gain valuable experience in real-time decision making in the context of myriad game situations and under the pressure of baserunners moving at game speeds.

In a pick off attempt drill, baserunners are commanded to take their leads by the HMI users. The coach signals to pitcher for a pick-off attempt. Once the pitcher throws, the coach can return baserunners to their bases on-time or late to give pitcher and base fielder different scenarios.

In a "looking" runners back drill, fielders that are required to make a defensive play by throwing to some upstream base must first "look back" to higher value baserunners at downstream bases. A user can judiciously command downstream baserunners to "retreat" only when they feel the defensive player has effectively "looked" a baserunner back by sufficiently feigning a throw to that bag.

A fielder's choice drill involves the system 10 implementing a throw decision-making drill where fielders line up behind a position (eg. short stop or 2nd base). A baserunner or pulse 2 is positioned at a "downstream" base (2nd or 3rd). The ball is hit and baserunners are commanded in a way that challenges the fielder's throw decision.

The methods of the present system 10 are discussed more fully below. Generally, baserunners should be controlled by users to prevent collision or passing between them but having multiple baserunners on the same basepath is still a possible condition while using the system which is potentially problematic for HMI 3 targeting reasons. If buttons are assigned to represent a particular basepath, once two baserunners occupy the same basepath, targeting immediately becomes ambiguous and another targeting scheme is required to differentiate baserunners. Targeting relies on a particular HMI 3 input convention to distinguish between baserunner pulses in such ambiguous situations such as particular button combinations or gestures that rely on accelerometers that are commonly embedded in HMIs 3.

Another option is envisioned where speed for the baserunner can be adjusted in real-time. For this feature, the speed of all the baserunners are simultaneously affected at once or individually. A user should be able to quickly and easily slow baserunners down to a really slow level to give kids time to think about their situational choices in "slowed-down" real-time. As they demonstrate good decision-making, slowly, precisely and globally increase baserunner speed.

Another feature is envisioned where the user can calibrate baserunner speed by having one or more kids "race" an LED pulse 2. The user initiates calibration mode via HMI 3 button-press. The user then commands a baserunner pulse 2 to appear at a base while simultaneously calling for a player to race the pulse. After the race is started, the user adjusts the baserunner pulse 2 speed to be in synch with the live baserunners velocity. It is not important whether the pulse 2 or the live baserunner "wins" the race—only that they are traveling at the same velocity by the end of the race. The software "back-calculates" the velocity of the player and stores the value.

Another feature is envisioned where pulse 2 speeds are randomly set. When this setting is invoked, the pulse 2 speed for each pulse placed, would be randomly varied higher/lower by some allowed tolerance above/below the velocity setpoint entered in the settings.

Another feature is envisioned that utilizes dynamic outs where baserunner pulses 2 are indicated as "out" by changing LED colors, blinking, or similar effect(s) in order to strongly visualize the out. The animation occurs immediately upon the user registering the out on the HMI 3. Yet another method of play is dynamic safes in which the baserunners are indicated as "safe" by changing colors, blinking, or similar effect(s) in order to strongly visualize they arrived to a base safely.

Yet another feature is dynamic safes in which the baserunners are indicated as "safe" by changing colors, blinking, or similar effect(s) in order to strongly visualize they arrived to a base safely. Whenever pulses 2 reach or pass bases, the visualization of the pulse 2 changes to indicate the associated base was safely arrived at.

Another feature is envisioned that utilizes targeting feedback where baserunner pulses 2 are indicated as "targeted" by changing LED colors, blinking, or similar effect(s) in order to strongly visualize that the user is currently targeting a particular pulse 2 through their currently-active HMI 3 input commands. The animation occurs immediately upon the user registering a targeting command on HMI 3 and maintains the visualization as long as the targeting command remains active.

Another feature is envisioned where baserunners reaching home plate are strongly indicated with a special colorization and/or animation sequence.

Yet another feature is envisioned which is a color adjustment feature that allows the system 10 user to change between various color options to represent baserunner pulses 2 and possibly other colorized features such as dynamic outs, runs, etc.

Yet another feature is envisioned that modifies the animated visualization of baserunner pulses 2 by adding acceleration and deceleration. From a stopped position, rather than immediately starting-off at the software-stored baserunner pulse 2 speed value, baserunner pulses 2 would accelerate when leaving a base 40 and decelerate when arriving at bases 40 (in a reach condition). This action would better simulate the kinematics of a live baserunner.

Yet another feature is parameter adjustment feature that anticipates parameterization of numerous variables that affect the system's 10 input and output characteristics. Using this feature, the system 10 user can change program values stored within the controller 4 values to accomplish customization of the system 10. In this way, numerous parameters in the system 10 are envisioned to be adjustable by the end-user. A settings button (physical or virtual) is envisioned which allows users to select and show current values for parameters and provide visualized feedback to newly adjusted values that have been modified on the system 10.

If parameter values are made to be adjustable, they must necessarily be visualized for users. Parameter values may be visualized via LED illumination on basepaths. Colorization and LED counts could be used for such visualization. Example parameters include: baserunner pulse 2 velocity, primary lead distance, secondary lead distance, baserunner pulse 2 color, out color, safe color, baserunner acceleration, and randomization parameters.

Yet another feature is scrimmage mode that sets in opposition two groups of infielders against each other, facilitating fun competition between them. Coaches hit balls from home plate to simulate an opposing teams' offensive hits. baserunners always start at home plate and progress as controlled by normal system 10 user control via HMI(s) 3. baserunner pulses that manage to progress all the way around to home plate without getting outed are counted by the system 10 and scores are kept for each defensive unit. The score can be witnessed at any time by registering a combination of buttons on the HMI 3 which visually indicates runs for each unit as either single or groups of illuminated LEDs. LED's indicating runs can be shown along different basepaths, in different colors or similar visualizations to keep track of the score.

Yet another method of play is randomized parameters to help ease the burden of the user having to setup baseball scenarios. The randomize feature is envisioned to be implemented where various aspects of different situations are automatically generated and presented. Examples may include: random positions with baserunners are placed at random positions on the basepaths; random speeds with placed baserunners are assigned random speeds within max/min settings; random leads with placed baserunners are assigned random lead lengths within max/min setting; and random taunt with placed baserunners exhibit different taunting patterns to simulate real baserunners.

Yet another feature is stored scenarios in which one or more macros included for storing and recalling baserunner scenarios quickly such as those listed below: replay macro allowing users to quickly re-enable all baserunners that were either outed or that scored and place them back at their prior positions before the last batted ball sequence was executed; get one; get two; first and third; bases loaded. It should be noted that, the speed at which baserunners can be manipulated with the system 10 may render this feature moot. In other words, if there is little time savings associated with a macro, it is similarly not valuable. Yet another method of play is controller button customization that allows a user to modify button/action assignments (ie. allow buttons to be used as macros).

Yet another feature is baserunner animations to modify the coloration and animation on LED strips. Any portion of an LED strip, down to even a single pixel, could be displayed in any RGB color and visually rendered to simulate any linear animation along a basepath. Baserunner pulses 2 may be visually represented as either a segment of consistently-bright LED's or the pulse 2 segment brightness can sequentially diminish to create a "comet tail" effect. Other options for baserunner pulse 2 customization include various baserunner pulse 2 coloration, light intensities and animations.

A method of use is envisioned for the system 10 to coach/practice baseball "pickle play" scenarios. This option may be more aptly described as a mode or method of utilizing the system 10. In this method a baserunner pulse is initiated and animated to somewhere along the basepath. The user commanding the baserunner challenges players ability to make quick throws back and forth in modeling a baseball "pickle" play by reversing baserunner pulse direction quickly/unpredictably. Players not involved in the pickle play are encouraged to "back fill" to bases behind those players closest to the baserunner pulse just like in a real-game pickle-play. Advanced play would include simulating a pickle play along the 1st/2nd basepath with a baserunner on 3rd. Challenge players to execute the pickle play while "checking" the baserunner on third to avoid giving up a run. This drill teaches players how to work plays on upstream bases without forgetting about higher-value, downstream baserunners. Although it is technically possible to execute this drill on each and every basepath, due to safety concerns, it may be best to stipulate that such a drill only be executed on parallel basepaths such as the home/1st basepath and the 2nd/3rd basepath or conversely the 1st/2nd basepath and the 3rd/home basepath. Simulating pickle plays on perpendicular basepath's with multiple balls increases the likelihood of players getting struck by balls and players running into each other. Alternatively, depending on physical wiring and hardware limitations, it may be possible to re-orient the four lighting strips associated with the system 10 into four parallel lines some distance apart. In such a situation, all four basepaths could be used to efficiently and safety simulate four pickle scenarios at once. Naturally, pickle plays typically come down to precisely-timed, change-of-direction events that occur with ever-increasingly frequency as the play develops. Therefore, it is likely unreasonable for a single user to control more than a single baserunner on a basepath being used for pickle play simulation. Rather, this option is likely best accommodated by the present system 10 where the HMI smart-device option is implemented with a different user being used to command each baserunner.

A feature is envisioned that is persistent outs where the visualization of baserunners 2, commanded to be out is maintained for a definite period where that period is either definitely determined by time or for an indefinite way that corresponds to a particular user input command. If by user input, baserunners 2 will maintain the visualization consistent with having a status of 'out' until which time the user invokes the input command to clear the basepaths. At this time, the visualization of 'outed' baserunner pulses 2 ends and the associated LED pulses are disabled (no longer illuminate).

A feature is envisioned that is virtual cones whereby a user can command the system 10 to enter a certain mode that facilitates baseball throwing drills that are common in practices—especially during pre-practice warm-up. Invoking this mode would cause LED light pixels or groups of the same to illuminate in a pattern so as to serve as visual markers for players to quickly and consistently align themselves in throwing lanes for such throwing drill work. The illuminated pixels whether individual pixels or groups of illuminated pixels similar to how the baserunners 2 are visualized would align with each other from opposing basepaths. For instance, the pixels or groups of pixels patterned along, say, the basepath between home and first would align with be re-created on the parallel basepath between second and third base so that conspicuous lanes were formed to serve as visual indicators of where players should align across from each other during throwing drills. The opposing basepaths of first to second and third to home could also be used for the same. The LED strips 1 could also be rearranged from the shape of a traditional baseball diamond to an entirely linear configuration and similar patterning be implemented to provide throwing lane indicators to players. Although this configuration would only provide a visual reference for the players on one side of a throwing area, it would still provide visual partitioning of the throwing area and, owing to the longer length, provide more throwing lane visualizations.

A feature is envisioned that accommodates system 10 deployment orientation. Whereas, in the standard configuration, the system 10 can be plugged into a general 120V wall receptacle, such a receptacle may not conveniently be available near where a user would like to position home plate. A field orientation feature is therefore envisioned whereby a user can modify the assignment of input buttons on the HMI 3 to correspond with different bases. Mostly conveniently, the user would be able to invoke selections that result in ninety-degree rotations in the programmed assignments of HMI 3 button to bases 40. In this way, whenever the user commanded a baserunner pulse 2 to appear at home plate by targeting the standard button representing home, instead of that baserunner pulse appearing as a pulse 2 near where the micro-controller 4 connects the system 10, the same would now appear at another base now designated to serve as home. Other targeting assignments and commands would be similarly rotated to achieve an overall result of a virtual rotation of the field. The net benefit of this feature is that it would decouple the orientation of the system 10 from the power connection location 5. Using this feature, the user could plug power connection 5 in at the most convenient location with getting to use the system in the orientation most convenient way. This is important because some facilities have spatial and architectural configurations that are especially conducive to a particular system 10 layout but that otherwise do not have a power connection point conveniently available near the home plate location of the system's 10 standard home plate assignment.

It will be understood that certain features and subcombinations are of utility and may be employed without reference to other features and subcombinations and are contemplated within the scope of the claims Not all steps listed in the various figures need be carried out in the specific order described.

What is claimed is:

1. A system for training a baseball player using light as a representation of a baserunner along a basepath, the system comprising:

the basepath comprising:

a first light strip having a plurality of light emitting diodes arranged linearly along a longitudinal length of said first light strip;

a second light strip having a plurality of light emitting diodes arranged linearly along the longitudinal length of said second light strip, said second light strip being positioned perpendicularly to said first light strip;

a quick release connection having releasably connected to said first light strip and said second light strip, said quick release connection configured to connect power and signal wiring between said first light strip and said second light strip;

a micro-controller configured to generate an illuminated segment along said basepath; and a controller configured to allow a user to input a command to issue control signals to said micro-controller to control movement of said illuminated segment along said basepath to simulate movement of the baserunner.

2. The system of claim 1, wherein said quick release connection has a first joining connector releasably connected to said first light strip.

3. The system of claim 2, wherein said quick release connection has a second joining connector releasably connected to said second light strip.

4. The system of claim 1, wherein at one of said plurality of light emitting diodes include at least one color light emitting diode.

5. The system of claim 1, wherein said controller is configured to issue programmed control signals to said micro-controller to initiate pre-set or user-adjustable movement patterns of said illuminated segment along said basepath.

6. The system of claim 1, wherein a visual representation of said illuminated segment may be customized to change light intensities, colors, size, and light-based animations.

7. A system for training a baseball player using light as a representation of a baserunner along a basepath, the system comprising:

the basepath comprising:

a first light strip having a plurality of light emitting diodes encased in molding and arranged linearly along a longitudinal length of said first light strip;

a second light strip having a plurality of light emitting diodes encased in molding and arranged linearly along the longitudinal length of said second light strip, said second light strip being positioned perpendicularly to said first light strip;

a quick release connection having releasably connected to said first light strip and said second light strip, said quick release connection configured to connect power and signal wiring between said first light strip and said second light strip;

a micro-controller configured to generate an illuminated segment along said basepath; and a controller configured to allow a user to input a command to issue control signals to said micro-controller to control movement of said illuminated segment along said basepath to simulate movement of the baserunner.

8. The system of claim 7, wherein said quick release connection has a first joining connector releasably connected to said first light strip.

9. The system of claim 8, wherein said quick release connection as a second joining connector releasably connected to said second light strip.

10. The system of claim 7, wherein at one of said plurality of light emitting diodes include at least one color light emitting diode.

11. The system of claim 7, wherein said controller is configured to issue programmed control signals to said micro-controller to initiate pre-set or user-adjustable movement patterns of said illuminated segment along said basepath.

12. The system of claim 7, wherein a visual representation of said illuminated segment may be customized to change light intensities, colors, size, and light-based animations.

13. A system for training a baseball player using light as a representation of a baserunner along a basepath, the system comprising:

the basepath comprising:

a first light strip having a plurality of light emitting diodes arranged linearly along a longitudinal length of said first light strip;

a second light strip having a plurality of light emitting diodes arranged linearly along the longitudinal length of said second light strip, said second light strip being positioned perpendicularly to said first light strip;

a micro-controller configured to generate at least one illuminated segment along said basepath; and a handheld controller configured to allow a user to input a command to control movement of said at least one illuminated segment along said basepath in real time to simulate movement of the baserunner to provide instruction to a baseball player.

14. The system of claim 13, wherein said basepath further comprises at least two bases.

15. The system of claim 14, wherein said command to control movement of said at least one illuminated segment selected from the group consisting of:

progressing said illuminated segment downstream along said basepath until otherwise commanded;

stopping said illuminated segment;

retreating said illuminated segment upstream along said basepath towards a prior base of said at least two bases; and incrementally progressing said illuminated segment downstream towards a next base of said at least two bases.

16. The system of claim 13, wherein a visual representation of said at least one illuminated segment may be customized to change light intensities, colors, size, and light-based animations.

* * * * *